United States Patent [19]

Kikuchi

[11] Patent Number: 4,573,618

[45] Date of Patent: Mar. 4, 1986

[54] APPARATUS FOR UNROLLING AND SPREADING ROLLED CLOTH

[75] Inventor: Hidetomo Kikuchi, Nishinomiya, Japan

[73] Assignee: N.C.A. Co., Ltd., Oosaka, Japan

[21] Appl. No.: 631,904

[22] Filed: Jul. 18, 1984

[51] Int. Cl.[4] ..... B65H 23/22

[52] U.S. Cl. ..... 226/42; 242/62

[58] Field of Search ..... 226/24, 42, 43, 45, 226/20, 108–111; 26/74, 75, 78, 99; 242/67.1, 67.2, 62; 250/559, 561, 571

[56] References Cited

U.S. PATENT DOCUMENTS

| | | | |
|---|---|---|---|
| 3,385,493 | 5/1968 | Klein et al. | 226/42 |
| 3,782,649 | 1/1974 | Frederick et al. | 242/67.2 |
| 3,807,613 | 4/1974 | Holm | 226/42 |
| 4,297,586 | 10/1981 | Rodgers | 250/561 |

*Primary Examiner*—Leonard D. Christian

*Attorney, Agent, or Firm*—Oblon, Fisher, Spivak, McClelland & Maier

[57] ABSTRACT

An apparatus for unrolling and spreading a long roll of cloth on a work table in which a servo motor is coupled with wheels of a spreader and for running the spreader on the work table. A servo motor is coupled with a dispensing roller and for rolling out the cloth roll rotatably supported on and by the spreader. A servo motor is coupled with a delivery roll for delivering the cloth unrolled by the dispensing roller onto the work table. First sensing means senses a running distance of the spreader. Second and third sensing means sense rotation speeds of the dispensing servo motor and the delivery servo motor, respectively. A control circuit generates a first control output signal to drive and control the running servo motor according to a preset input and the output signal from the first sensing means. An operational comparing circuit generates second and third control signals for synchronizing the dispensing and delivery servo motors in rotation with the running servo motor, a given variable factor of multiplication is coupled with the output signal from the first sensing means, the output signal modified by the multiplication factor is individually compared with the output signals from the second and third sensing means, and the first control output is gain-controlled by each of the results of the comparisons.

8 Claims, 8 Drawing Figures

APPARATUS FOR UNROLLING AND SPREADING ROLLED CLOTH

BACKGROUND OF THE INVENTION

This invention relates to an apparatus for unrolling and spreading rolled cloth and, more particularly, to an apparatus for unrolling and spreading rolled cloth, which stably spreads rolled cloth with a simple construction.

Generally, cloth is rolled into a large roll. For cutting the rolled cloth, preparatory work is needed in which the cloth is unrolled, spread, cut a desired length, and stacked or folded. To this end, a rolled cloth spreading apparatus has been developed. In the apparatus, an elongated work table is set horizontally, a spreader is movable in the longitudinal direction of the work table. A long roll of cloth is rotatably set in the spreader in a suspended fashion, while being located at a predetermined distance from the foward end of the spreader as viewed in the advance direction thereof. The rotatably suspended cloth is unrolled by a roller, operationally coupled with a drive motor, and spread on the work table. During the course of the unrolling and spreading operation, tension is generated in the roll of cloth and the unrolled cloth. Particularly, when the cloth is thin, the tension causes wrinkles on the unrolled cloth or impedes the unrolling operation because the thin cloth is resiliently expanded or contracted. When thick cloth such as denim or shynthetic leather is rolled into a roll with a large diameter, a relatively large force is required at the initial stage of unrolling the cloth; hence, slippage tends to occur between the cloth and the delivery roll. This makes it difficult to unroll the cloth at a fixed amount per unit time.

There is a proposal to solve this problem. In the proposal, two individual drive motors are separately provided. One is for driving the roll to roll the woven cloth into a roll of cloth and to unroll the rolled one. The other is for driving a delivery roll to deliver the unrolled cloth for spreading and to deliver the woven cloth for rolling into a cloth roll. In operation, both the motors are rotated in a synchronizing manner, thereby automatically effecting the preparatory work. In spreading the cloth, both the motors must be rotated in synchronism with the running of the spreader. To this end, when the rolled cloth is taken out, wheels of the spreader are mechanically disconnected from the drive shafts thereof by means of an electromagnetic clutch. Then, the disconnected drive shaft is mechanically connected to the roll-up roll and the delivery roll by means of a chain or a gear for providing the synchronous rotation of the rolls. In this case, even if both the rolls are synchronous in operation to have fixed periphery speeds, the unrolled and spread cloth is frequently trailed. Specifically, the cloth with variously different natures is actually handled. Because of this, inertia of the rolled cloth differs for each cloth. The difference of the cloth inertia gives rise to slippage between the dispensing roller and the rolled cloth and between the dispensing roller and the cloth. As a result, the unrolled cloth is not coincidence in length with the running distance of the spreader. In this way, cloth trailing occurs.

To solve this, a mechanical nonstep transmission is coupled with the drive shafts for the wheels of the spreader, the delivery roll, and the roll-up roll. According to the nature of the cloth used, a change gear ratio of each change gear is changed in the range of 0.8–1.2. This approach goes well as long as the rotating speed thereof is invariable. In actual use, however, it is difficult to keep the transmission gear ratio at a fixed value because the spreader frequently repeats start, acceleration, deceleration, and stop, and particularly in repeatedly spreading the rolled cloth, the forward and reverse motions of the unrolling machine are alternately repeated. Additionally, slippage occurs between the wheels and the related rails. A variation of the transmission gear ratio due to slippage and a change of the weight of the cloth also brings about that inequality problem of the running distance of the spreader to the length of the unrolled cloth, even if the change gear ratio is optimumly adjusted according to the nature of the cloth and the result of observing the unrolling state of the cloth. This results in trailing or slackening of the cloth due to excessive take-out thereof.

To eliminate the adverse effect on the cloth by the inertia, an additional motor is provided for driving the dispensing roller in an unroll mode. A conveyor interlocked with the delivery roll is provided under the dispensing roller. A distance roll is provided at the midpoint therebetween and controls the motor for driving the dispensing roller. This approach, however, is complicated in structure and instable in operation.

SUMMARY OF THE INVENTION

Accordingly, an object of the present invention is to provide an apparatus for unrolling and spreading rolled cloth, which stably unrolls and spreads the rolled cloth with a simple structure.

According to the present invention, there is provided an apparatus for unrolling and spreading a long roll of cloth on a work table comprising: a servo motor coupled with spreader wheels for running the spreader on the work table; a servo motor coupled with a dispensing roller and for unrolling the roll rotatably supported on and by the spreader; a servo motor coupled with a delivery roll for delivering the cloth dispensed by the roller onto the work table; first sensing means for sensing a running distance of the spreader, second and third sensing means for sensing a rotation speeds of the dispensing servo motor and the delivery servo motor, respectively; a control circuit for generating a first control output signal to drive and control the running servo motor according to a preset input and the output signal from the first sensing means; and an operational comparing circuit in which a given variable multiplication factor is coupled with the output signal from the first sensing means, the output signal modified by the multiplication factor is individually compared with the output signals from the second and third sensing means, and the first control output is gaincontrolled by each of the results of the comparisons, thereby generating second and third control signals for synchronizing the unrolling and delivery servo motors in rotation with the running servo motor.

With such a structure, the unrolling and spreading apparatus is simplified in structure, and has no need for complicated adjustment. Further, the dispensing motor and the delivery motor may effectively be synchronized with the running of the spreader by means of an electrical circuit means, not the mechanical nonstep transmission. Therefore, the unrolling and spreading of the rolled cloth may be executed stably and reliably, while being free from the trailing of the cloth.

BRIEF DESCRIPTION OF THE DRAWINGS

The present invention can be understood by reference to the accompanying drawings, in which.

DETAILED DESCRIPTION OF THE PREFERRED EMBODIMENTS

Figure 1:
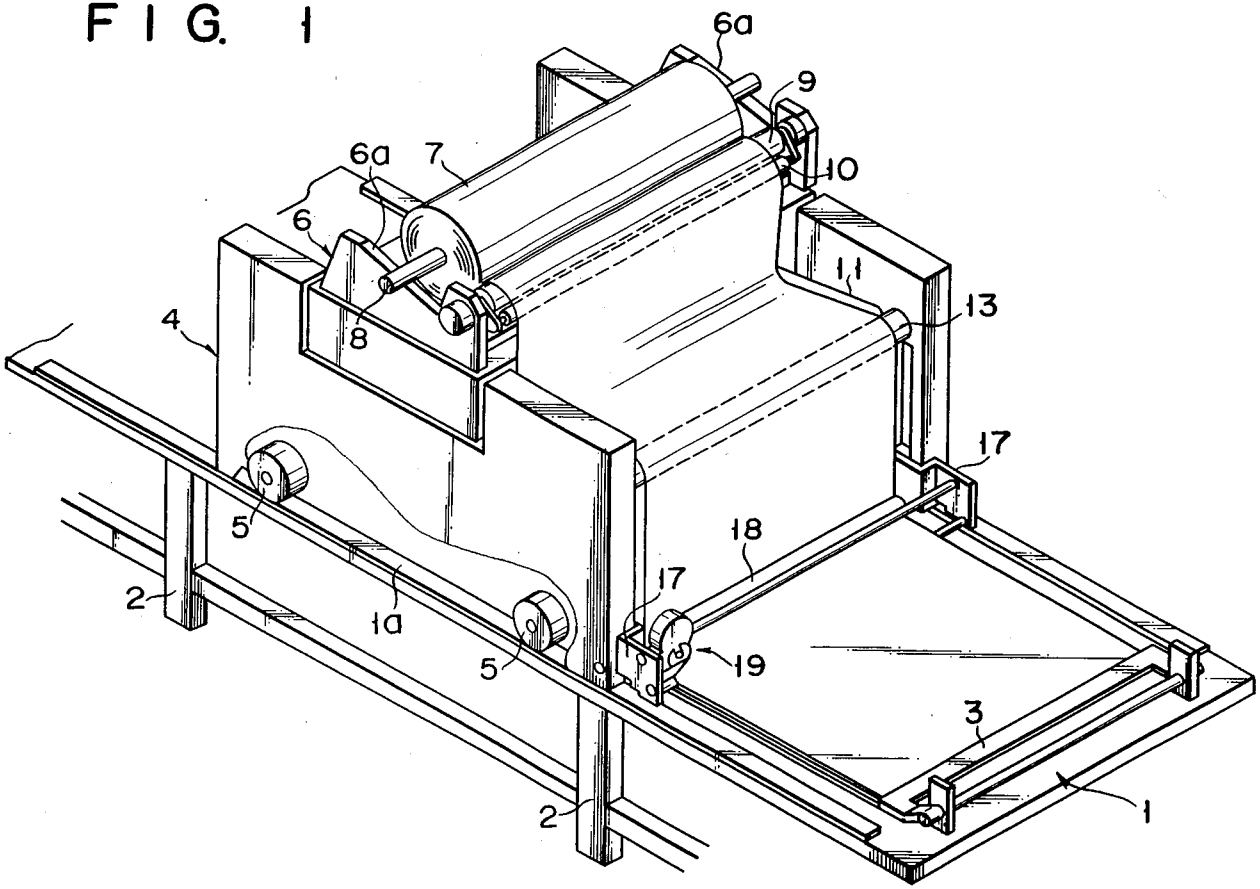
FIG. 1 is a perspective view of a mechanism for which a first embodiment of the present invention is applied.
Figure 2:
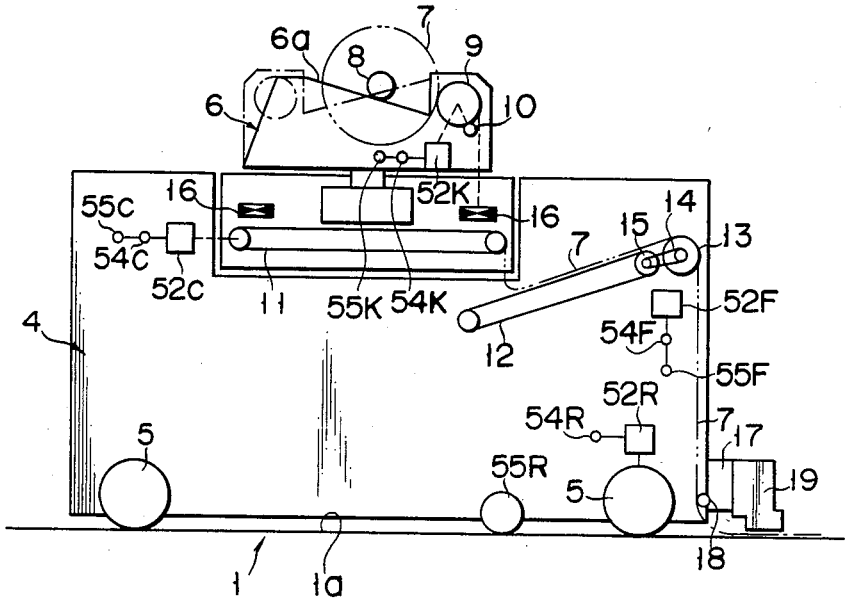
FIG. 2 schematically illustrates a front view of the mechanism of FIG. 1.

A first embodiment of the present invention will be described referring to FIGS. 1–5. In FIG. 1, showing a view of an unrolling and spreading apparatus mechanism, a plain rectangular work table 1 is horizontally supported by a number of support legs 2. A catcher 3 is mounted on one end portion of the work table 1. A spreader 4 is movably set on the work table 1 such that wheels 5 rotatively mounted to the spreader 4 are rollable on related rails 1*a* longitudinally laid out on the work table 1. Specifically, a motor 52R contained in the spreader 4 (FIG. 2) drives the wheels 5 to move the spreader 4 forward and backward against the catcher 3. A support table 6 is rotatably mounted on the spreader 4, while operationally coupled with a horizotnal, rotation drive mechanism to be described later. The support table 6 is provided at both sides with a couple of edge surfaces 6*a* down tapered in the forward direction of the movement of the spreader 4. A shaft 8 of a long roll of cloth, which is received by suitable bearings (not shown), is supported by the tapered edge surfaces 6*a*, so as to allow the shaft 8 to move along the tapered edge surfaces 6*a* according to the weight of the rolled cloth, which depends on an amount of taken or dispensed cloth. Rotatably disposed adjacent to the tapered edge surfaces 6*a* is a dispensing roller 9 with a non-slip layer made of urethane rubber or felt formed thereon. The dispensing roller 9, which is always in contact with the rolled cloth, is driven by a motor 52K (FIG. 2), thereby to unroll the rolled cloth 7 into a sheet of cloth. An auxiliary roll 10 is rotatably disposed under the dispensing roller 9. The diameter of the former is smaller than the latter. The long cloth 7 taken out by the dispensing roller 9 is temporarily in contact with the auxiliary roll 10 and then delivered down the line. As shown in FIG. 2, a belt conveyor 11 coated with non-slip material, horizontally laid below the support table 6, is rotatably supported by the support table 6. The belt conveyor 11 is driven by a motor 52C in the running direction of the spreader 4. A delivery roll 13 coated with non-slip material is rotatably mounted to the spreader 4, while being located at one end of the belt conveyor 11 down the line from the cloth flow. The delivery roll 13 is driven by a motor 52F. An auxiliary belt conveyor 12 is interposed between the belt conveyor 11 and the delivery roll 13. The conveyor 11 and 12 are mechanically coupled with each other by a transmission means 14 such as a chain. Preferably, a switching means 15 such as an electromagnetic clutch is provided so that the auxiliary belt conveyor 12 is disconnected from the belt conveyor 11, allowing the auxiliary belt conveyor 12 to operate independently of the delivery roll 13. With this structure, the cloth 7 taken out by the dispensing roller 9 is transferred onto the belt converyor 11 and then to the auxiliary belt conveyor 12, and reaches the delivery roll 13. The cloth 7 is then delivered by the delivery roll 13 and spread onto the work table 1. In FIG. 2, a photo sensor 16 senses the position of the cloth 6. Using the sensed signal from the photo sensor 16, the support table 6 is moved for adjustment in the direction normal to the running direction of the spreader 4. Through the adjustment, the cloth 7 is adjusted in the width direction when the cloth 7 is transferred from the auxiliary belt conveyor 12, rotatably mounted on the support table 6, to the delivery roll 13. In this way, the width alignment of the cloth 7 is performed when the cloth 7 is delivered. A couple of lift brackets 17 and 17 are horizontally and movably mounted at the lower portions of both side walls of the spreader 4. The lift brackets 17 are driven to horizontally move by means of a lift mechanism (not shown) provided in the spreader 4. A final guide roll 18 and a cutter unit 19 are mounted to the lift brackets 17 such that the cloth 7 is set at a predetermined height by the guide roll 18 and is cut in the width direction at this height by the cutter unit 19.

Figure 3:
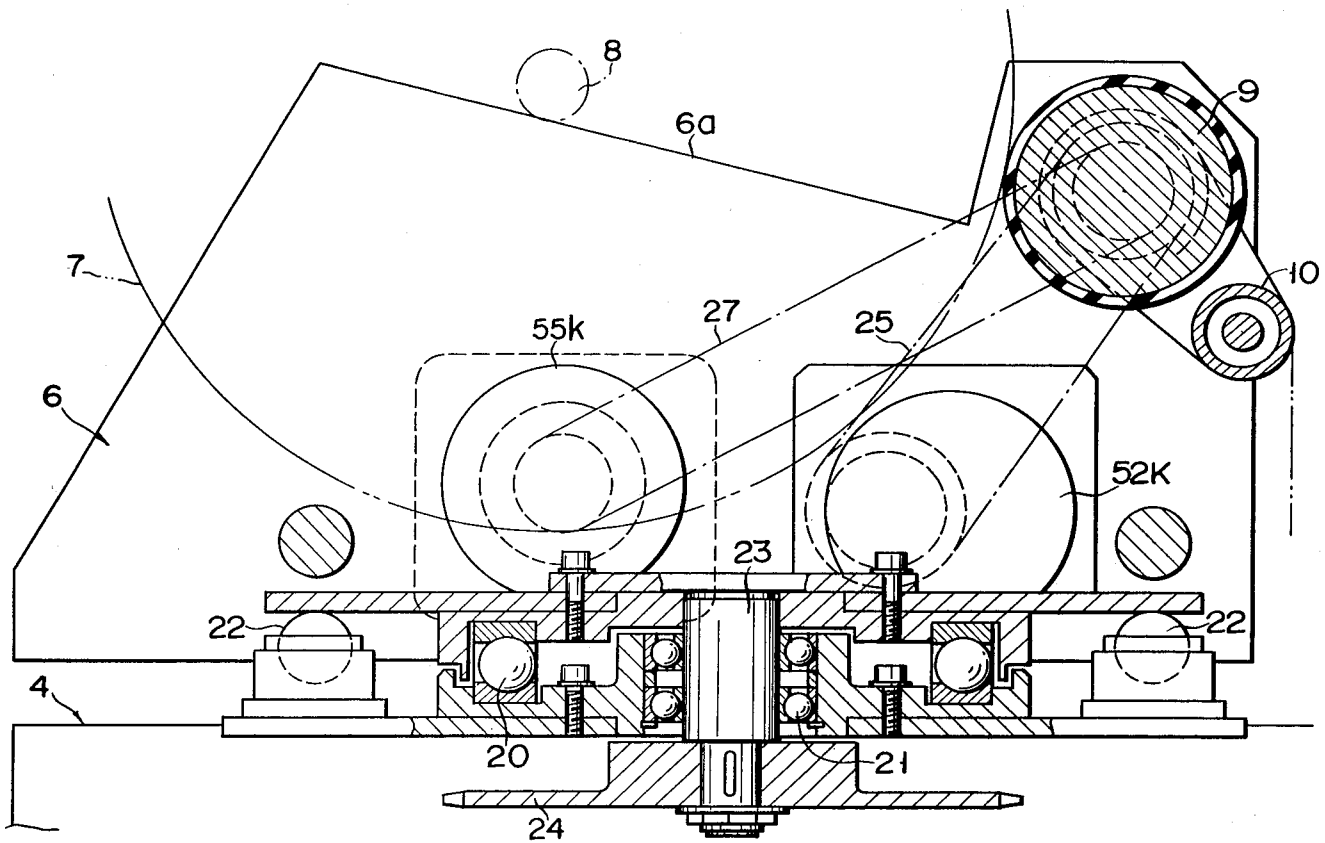
FIG. 3 shows a partial longitudinal sectional view of a support table section in the mechanism of FIGS. 1 and 2.

Turning now to FIG. 3, there is illustrated in detail the horizontal rotation drive mechanism for the support table 6. As shown, the support table 6 is horizontally and rotatably mounted to the spreader 4 by means of a thrust bearing 20, a radial bearing 21 and a ball bearing 22. A sprocket 24 is mounted to a support shaft 23 suspended from and formed integral with the support table 6. With the rotation of the sprocket 24, driven, for example, by the combination of a motor and a chain (not shown), the support table 6 is turned to the forward and backward directions of the spreader 4. A motor 52K drives the dispensing roller 9 through a chain 25. A rotary sensor 55K such as a rotary encoder records the number of rotations of the dispensing roller 9, and is coupled with the dispensing roller 9 through a timing belt 27.

Figure 4:
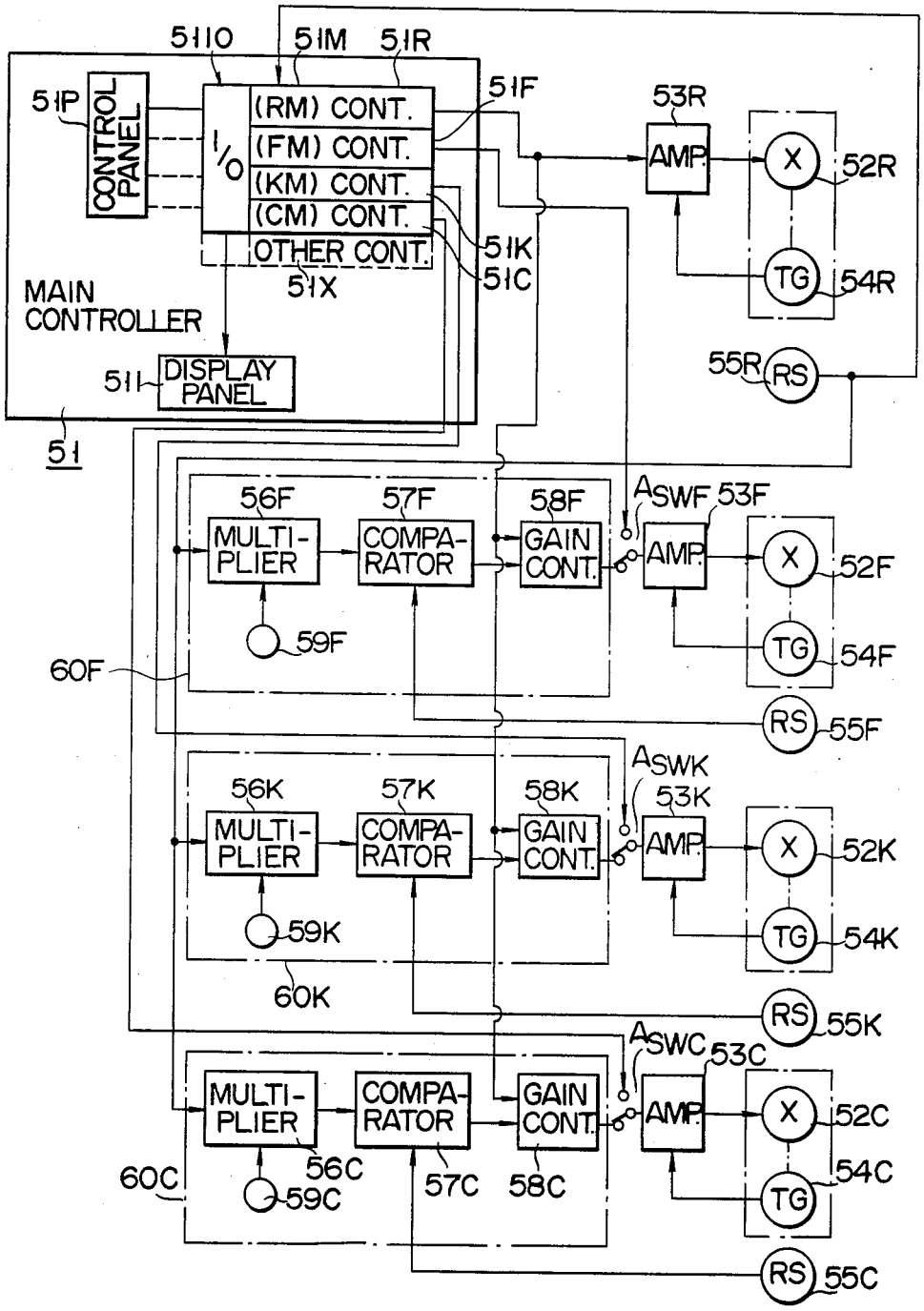
FIG. 4 is a block diagram of a synchronizing control circuit for which the first embodiment of the present invention is applied.

A synchronizing control circuit section for motors driving the drive shafts of the rolls, the wheels, etc., used in the above-mentioned mechansim will be described referring to FIGS. 4 and 5. As shown in FIG. 4, a main controller 51 is comprised of a control panel 51P, a main control circuit 51P, and a display panel 51I for displaying data input from the control panel 51P and data representing a state of work progression. The main control circuit 51P includes a control circuit 51R for generating a control voltage according to the input signal from the control panel 51P and for applying it to the motor 52R for driving the wheels of the spreader 4; a control circuit 51F for generating a control voltage to drive the motor 52F for the delivery roll 13; a control circuit 51K for generating a control voltage to drive the motor 52K for the dispensing roller 9; a control circuit 51C for generating a control voltage to the motor 52C for the conveyor; and other necessary control circuits.

An input/output circuit 51IO containing an interface circuit is provided to connect those control circuits to the control panel 51P. Those control circuits 51R, 51F, 51K, 51C are sequence controlled, and may be a digital or an analog circuit containing known relay logic and hardware logic. This embodiment uses 8-bit mciro-processors for those control circuits.

The other necessary control circuits are, for example, a control circuit for the motor to drive the width aligning section operable according to the output signal from the sensor, such as a photo relay containing a microswitch, a limit switch, and a photo sensor, a control circuit for the electromagnetic clutch, an electromagnetic brake, solenoids and the like, a control circuit for controlling a motor to drive the support table according to a sequence control condition, a control circuit for the motor to drive the cutter, and a control circuit for the motor to move the cutter unit. These control circuits are well known and no further explanation will be given.

The main controller 51 further includes control circuits for moving the cloth to select a start position of cloth rolling out, for taking out the rolled cloth 7 to a predetermined position when the cloth is set to the machine, for driving the cutter unit, for rotating only the cutter for polishing purposes, and for locking the remaining control circuits when the just-mentioned control circuits are operating. Those control circuits are also known and hence the explanation thereof will be omitted.

When the microprocessors are used for those control circuits 51R, 51F, 51K, and 51C, digital to analog converters (D/A converters) are used at the outputs of the controls circuits, respectively. Use of the D/A converters is also known, and the D/A converters are not shown in FIG. 4. Those control circuits may be formed by analog circuits, and in this case, of course, the D/A converters are not required.

The control outputs from the control circuits 51R, 51F, 51K and 51C are respectively connected through servo amplifiers 53R, 53F, 53K and 53C to the motors 52R, 52F, 52K and 52C. Tacho generators 54R, 54F, 54K and 54C are respectively coupled with the rotating shafts of the servo motors 52R, 52F, 52K and 52C. Those tacho generators each produce a positive or a negative voltage proportional to the rotating speed, which depends on the rotating speed and the rotating direction. The output signals from the tacho generators 54R, 54F, 54K and 54C are respectively fed back to the servo amplifiers 53R, 53F, 53K and 53C. Therefore, the motors 52R, 52F, 52K and 52C rotate in a direction and at a rotating speed both of which are dependent on the output voltages from the control circuit 51R, 51F, 51K and 51C, and are little influenced by a load variation. Therefore, all of the servo amplifiers 53R, 53F, 53K and 53C are concurrently started and operate substantially in synchronism with one another. This is possible if the circuit is designed such that the same rotating speed for all of the motors, the running speed for the wheels of the spreader, the periphery speed for the delivery roll and the dispensing roll, and the conveyor speed are equal to one another, and that a drive voltage equal to the output voltage of the motor 51R is applied to all of the motors 52R, 52F, 52K and 52C. This is attained even if the servo amplifiers 53R, 53F, 53K and 53C are of the conventional type, because they have a large gain and a proper amount of feedback. However, if those motors are made asynchronous in operation due to the slip of the wheeels or any other disturbance, it is impossible to restore the motor operation from its asynchronous state, i.e., if this arrangement is used as it is or without any modification. Further, it is impossible to properly adjust the rotating speed of the motors 52F, 52K and 52C because of the nature of the various types of cloth.

To solve this problem a rotary sensor 55R, such as a rotary encoder or a resolver, is provided in contact with the rails 1*a* on the work table 1 (FIGS. 1 and 2). The running distance of the spreader 4 is measured using the output signal from the rotary sensor 55R. The measured value is fed back to the control circuit 51R. Through this feedback, the spreader 4 is made to run a predetermined distance according to the input from the control panel 51P, and then is stopped. The output signal from the rotary sensor 55R in contact with the rails 1*a* is connected to input terminals of comparing circuits 57R, 57F, 57K and 57C through the respective multipliers 56R, 56F, 56K and 56C. The outputs of the rotary sensors 55R, 55F, 55K and 55C are respectively connected to the other input terminals of the comparing circuits 57R, 57F, 57K and 57C. The outputs of the comparing circuits 57F, 57K and 57C are respectively connected to input terminals of the gain control circuits 58F, 58K and 58C each of which functions such that by the input signal to one of the input terminals, gain of the input signal to the other input terminal is controlled. The other input terminals of the gain control circuits 58F, 58K and 58C are respectively coupled with the outputs of the control circuit 51R for the running motor. The above connections form variable reduction rate synchronizing circuits 60F, 60K and 60C, respectively.

Preset means 59F, 59K and 59C are respectively provided in multipliers 56F, 56K and 56C of the variable reduction rate synchronizing circuits 60F, 60K and 60C for the delivery roll, the dispensing roll and the belt conveyors, and can set a factor of multiplication in the range of 0.1 to 1.2.

Analog switches ASWF, ASWK, and ASWC are switched by the output signals from the control circuit 51F, 51K and 51C, respectively. Normally, the inputs to the servo amplifiers 53F, 53K and 53C may be connected to the outputs of the variable reduction rate synchronizing circuits 60F, 60K and 60C. If necessary, as will be described later, they are connected to the outputs of the control circuits 51F, 51K and 51C, respectively.

With such an arrangement, when the main controller 51 produces a control voltage, the control voltage is applied to the servo amplifier 53R for the running motor and to the servo amplifiers 53F, 53K and 53C for the remaining motors 52F, 52K and 52C through the gain control circuits 58F, 58K and 58C. The other motors also operate simultanously with the running motor. The gains of the gain control controllers 58F, 58K and 58C are increased or decreased by the output signals from the prestage comparing circuits 57F, 57K and 57C. Let us design the circuit in the following way. When the outputs of the rotary sensors 55F, 55K and 55C are equal to the output of the rotary sensor 55R in contact with the rotating sensor 55R, its gain is 1. When the former are smaller than the latter, the gain is increased to be larger than 1. In the reverse case, it is decreased to be smaller than 1. For 1 as the multiplication factor of the prestage multipliers 56F, 56K and 56C, the output of the corresponding rotary sensor is decreased when the rotating speed for any one of the motors 52F, 52K and 52C is decreased. Accordingly, the gain of the corresponding gain control circuit is larger than 1, and a voltage larger than the control voltage of the motor 52R is applied to the motor. And the motor is accelerated to recover the reduced speed rate of the motor. In the reverse case, the motor is decelerated in a similar manner. In this way, the running motor 52R operates in synchronism with the rotary sensor 55R in contact with the rails 1*a*.

As seen from the foregoing, this synchronization depends on the factor of multiplication of each multiplier 56F, 56K and 56C. The synchronizing control circuit as mentioned above is designed based on this fact and, hence, is operable like the mechanical nonstep change gear.

More specifically, if the data input from the control panel 51P represents "repeat ten times the cloth spreading of 10 m", for example, the output voltages corresponding to the data are sequentially output from the control circuit 51R for running the motor. Then, the cloth speading starts from a predetermined spreading start position. The control voltage of the running motor control circuit 51R varies to control the running motor such that it is accelerated at a predetermined acceleration to attain a predetermined speed, for example, 60 m/min., then continues the spreading at that speed, is decelerated at a predetermined deceleration just before the spreading stop position, and is stopped at a position representing 10 m which is indicated by the rotary sensor 55R. With the variation of the output voltage, the running motor 52R operates in a so-called servo locked state and stops when the output voltage is 0.

At this time, if all of the multipliers 56F, 56K and 56C have 1 as the multiplication factor, the motors 52F, 52K and 52C rotate in synchronism with the rotary sensor 55R in contact with the running rails 1*a*. Accordingly, if the wheels 5 (FIG. 1) slip, the above compensation for the slippage is exactly performed. If the speed of those motors is controlled so as to be incremented or decremented by means of the preset means 59F, 59K and 59C according to a state of the cloth spreading, the motor speeds increase or decrease with the multiplication factors, and continue their rotation under the control of the multiplication factors.

Further, the dispensing motor 52K is controlled by the voltage equal to the control voltage applied to the running motor 52R. Therefore, if the running motor 52R is controlled so as to have a soft start and a soft stop, the remaining motors effect the soft start or the soft stop. Further, if the control voltage of the running motor 52R is suddenly zeroed, the remaining motors also stop simultaneously. This indicates that the program for acceleration and deceleration, start, stop, etc., is sufficient to prepare for only the running motor 52R, and therefore the program is simplified.

Upon completion of the first forward spreading operation, the running motor 52R stops. At this time, the reverse voltage is applied to the running motor 52R. Then, the running motor 52R drives the spreader 4 backwards, while performing the acceleration, the fixed speed, deceleration, and stop operations as in the forward spreading operation. This sequence of operations is repeated several times and finally stops. Also, in this case, under the control of the voltage equal to the control voltage of the running motor 52R, the remaining motors 52F, 52K and 52C start simultaneously with and operate like the running motor 52R, and the asynchronous rotations of the motors are corrected by the rotary sensor 55R in contact with the rails 1*a*.

In a unidirectional spreading mode, after the first forward spreading is completed, a sequence of operations is executed under the control of the program contained in the main controller 51. For example, the solenoid is operated, and after it is stopped, the end of the cloth is held. The cutter unit 19 shown in FIG. 1 is driven and moved to cut the cloth 7. Then, the cutter unit 19 is stopped and returned to its original position. Further, the solenoid is again operated to release the end of the cloth 7. The running motor 52R is rotated in the reverse direction to return the spreader 4 to the original position. At this time, the analog switches ASWF, ASWK, and ASWC are operated so that the voltage for reversing the running motor 52R does not reverse the remaining motors. By operating the switches, those motors are disconnected from the variable reduction rate synchronizing circuits 60F, 60K and 60C as the operational comparing circuits with the application of zero to these circuits.

In a to fold the cloth with the upside in spreading mode, following the completion of the forward spreading mode, the solenoid is operated after the cutter unit 19 is stopped and releases the end of the cloth 7. The dispensing motor 52F, the dispensing motor 52K, and the conveyor motor 52C are reversed in rotation to take up the cloth 7 and turns the support table 6 180°. The cloth 7 is delivered out in the opposite direction, the end of the cloth 7 is set to the cutter unit 19, and it is moved backward to its original position. This sequential operation is not related to the running of the spreader 4. Then, the output signals from the control circuits 51F, 51K and 51C are respectively coupled with the servo amplifiers 53F, 53K and 53C by means of the analog switches ASWF, ASWK, and ASWC. Those servo amplifiers 53F, 53K and 53C are placed under control of the program the control circuits 51F, 51K and 51C.

Figure 5:
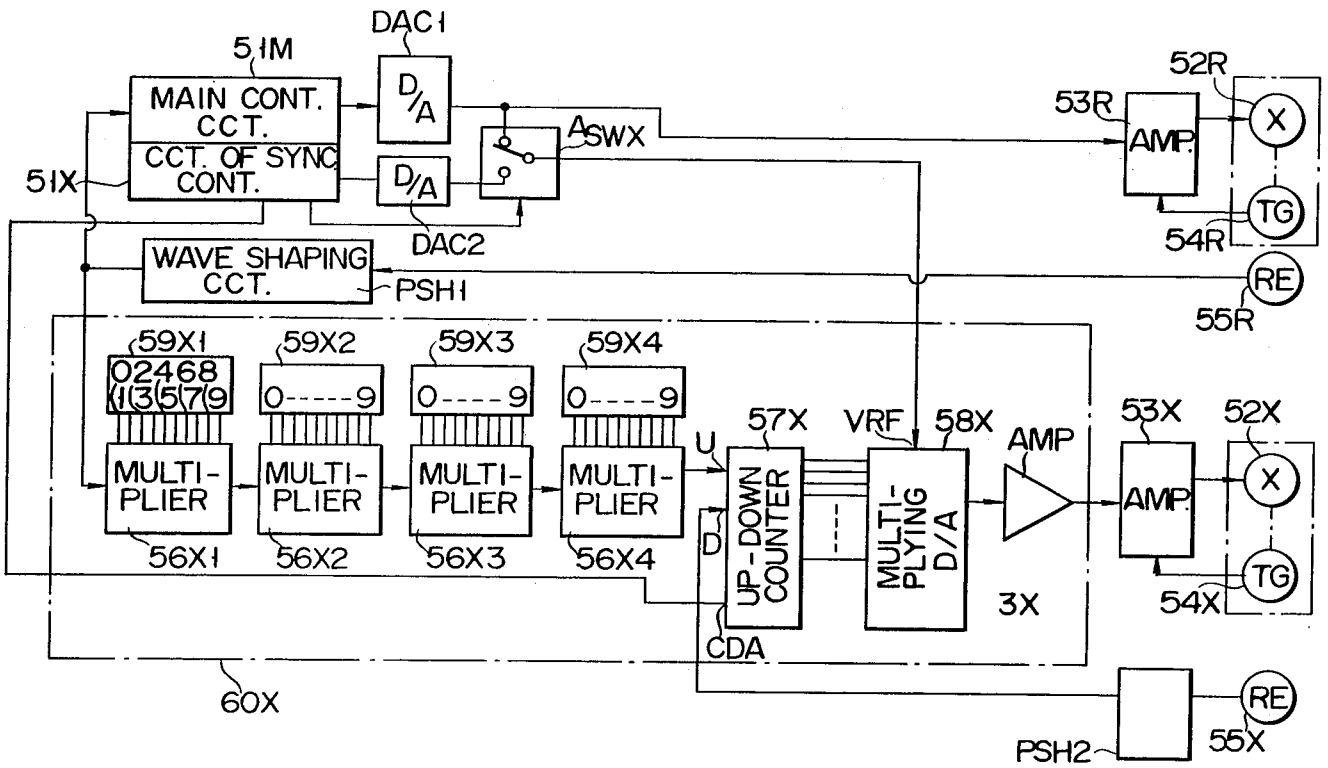
FIG. 5 is a block diagram illustrating in detail the circuit of FIG. 4.

A more detailed circuit of the circuit arrangement of FIG. 4 is in block form illustrated in FIG. 5. In this circuit, the circuit portion requiring the synchronization is formed of a single circuit by using rotary encoders for the rotary sensors 55R and 55X and implementing the operational comparing circuit 60X in hardware. Like symbols are applied to like or equivalent portions in FIG. 4 for simplicity.

A wave shaping circuit PSH1 converts the output signal from the rotary encoder 55R from a rotary sensor to a pulse signal. The pulse signal is then applied to a main control circuit 51P for the running motor and a multiplier circuit 56X1. An amplifier circuit AMP has a 2–3 amplification factor. DAC designates a D/A converter.

The main control circuit 51P, formed of an 8-bit microcomputer, produces an output signal for transfer to a servo amplifier 53R for the running motor via the D/A converter DAC1 of a predetermined accuracy (in this embodiment, 12 bits) and also to one input terminal of an analog switch ASW1 to be described later.

For the motor to be synchronized, for example, a delivery motor is also made up of the microcomputer as mentioned above. The output signal of the control circuit 51X is connected via a D/A converter DAC2 to the other input terminal of an analog switch ASWX like the above mentioned one. The analog switch SWX is switched by the output signal from the control circuit 51X, as described above.

56X1, 56X2, 56X3, 56X4 designate rate multipliers as multipliers. 56X1 represents the fourth digits; 56X2 represents the third digit; 56X3 represents the second digit; and 56X4 represents the first digit. Those rate multipliers 56X1, 56X2, 56X3, 56X4 are coupled with preset means 59X1, 59X2, 59X3, 59X4, respectively. When all the preset means are set at 0, 0 is set in the multipliers. When those are set at 9, 9999 is set. When the multiplier 59X1 is set at 5 and the remaining ones are set at 0, 5000 is set. If the multiplication factors are respectively 0.1, 0.01, 0.001, and 0.0001, it is preset at 0 to 0.9999. 57X designates an up/down counter as a comparator and is connected at the count disabling terminal CDA to the output terminal control circuit 51X. By the signal on the count disabling terminal CDA, the up/down counter 57X starts or stops the counting operation. A multiplying D/A converter (MDA) 58X changes its gain by a digital signal applied thereto. In this sense, the multiplying D/A converter (MDA) 58X is also called a digital controlled amplifier. This MDA also has the 12-bit accuracy. A voltage input terminal (called a VRef terminal) VRF of the MDA is connected to the select terminal of the analog switch ASWX. The output of the MDA is connected to a servo amplifier 53X of a motor 52X under control, through an amplifier AMP (in this embodiment, its amplification factor is fixed at 2, but it may be variable with an external control for the amplification factor).

With such an arrangement, a pulse signal generated by the rotary encoder 55R physically in contact with the running rails 1*a* is applied through the rate multipliers 56X1, 56X2, 56X3, 56X4 to the up terminal U of the up/down counter 57X. The output signal from a rotary encoder 55X directly or indirectly connected to the shaft of the motor 52X is passed through a wave shaping circuit PSH2 into a pulse signal, which in turn is applied to the down terminal D of the up/down counter 57X. Let us design this circuit such that when the number of the output pulses of the up/down counter 57X is zero, u-factor of the MDA58X is 1, and when the number of pulses is positive, the u-factor is increased, and if it is negative, the u-factor is decreased. Then, when the rate multipliers 56X1, 56X2, 56X3, 56X4 are set to 5000, the motor 52X rotates in synchronism with the rotary encoder 55R. The motor speed is controlled by changing the set value in the rate multipliers 56X1, 56X2, 56X3, 56X4, and the motor is synchronized according to its reduction ratio.

If there is a variance in the characteristic of the servo amplifiers and the servo motors and a variation in the voltage, the synchronization of the motor with the rotary sensor is automatically set up and the compensation for such variance and variation will be performed continuously. Therefore, immediately after manufacturing, it is run for a short time without setting the cloth to the apparatus. Then, the synchronization is automatically set up. Further, the MDA58X holds the u-factor when the synchronization is set up. Therefore, no adjustment of the circuit under control 51X is needed and its manufacturing is very easy. In other words, the synchronizing control circuit has a self-learning function in a sense. This function eliminates the need for the adjustment of the circuit under control. If the related circuitry is constructed using CMOSs, a battery back-up is employed, or a memory circuit is additionally used for storing neccessary data, and the respective motors start their rotation in a synchronized manner, requiring only minor compensation. Therefore, the spreading apparatus quickly enters into a stable phase operation, thus providing a smooth cloth spreading.

In the unidirectional spreading mode or the to fold the cloth with the upside in spreading mode, when the first spreading is finished, the cloth 7 is rolled up, the support table 6 is turned 180° and the rolled cloth is rolled out. The count disable terminal CDA of the up/down counter 57X is controlled by the output of the control circuit 51X, and is rendered in a low logical level. Then, the up/down counter 57X stops its counting operation. At this time, the MDA58X has stored the just-before most recent data (u-factor), and the synchronization is locked up as it is. Also in the sequential operation as mentioned above, a plurality of motors may be controlled by a single control signal based on a single program. Therefore, the program is simplified.

Also in the gain control circuit shown in FIG. 4, if a memory means such as a sample/hold circuit is provided, a self-learning function like the above one may be realized.

As seen from the foregoing, in the first embodiment of the present invention, a first rotary sensor physically in contact with the running rails and a second rotary sensor directly or indirectly in contact with the controlled motors form a closed loop in cooperation with the arithmetic operation circuit and the comparing circuit. At the starting time, as a control voltage is applied to the running motor, a voltage equal to or proportional to the control voltage is applied to the controlled motors. Therefore, all the motors are concurrently started, accelerated, decelerated and stopped according to the control voltage for the running motor. The correction for the synchronization is continued during the operation of the motors. Therefore, a very smooth spreading operation of the cloth is possible.

Further, the synchronization is set up at a preset factor of multiplication. A proper changing of the multiplication factor, which is allowed to be done during the running of the apparatus, provides the synchronization keeping function as obtained by the mechanical nonstep change gear. Additionally, a flexible wiring is allowed. This feature provides a very easy synchronization with the dispensing motor and the conveyor motor, which are mounted on the support table to be horizontally turnable and movable, those motions require a refined technique from the viewpoint of mechanical engineering. Therefore, the unrolling and spreading apparatus is improved in performance, cost, and maintenance.

The multipliers and the comparing circuits may be implemented by the software for the microcomputer. However, the 8-bit microprocessor currently used needs a long time for the processing when it is applied to those of the unrolling and spreading apparatus handling cloth of 60 m long per second. It is for this reason that those circuits are hardware. It is evident that they may be constructed of the software for the microcomputers for the main controller, or alternatively by another microprocessor.

The synchronizing control section used for the present invention is arranged and operated as thus far mentioned. In operation, the spreader 4 is first advanced toward the catcher 3. The leading end of the rolled cloth 7, which has been led to exterior position from the lower leading end portion of the spreader 4, is fixed on the work table 1 by the catcher 3. Then, the wheels 5, the dispensing roller 9, the belt conveyor 11 and the delivery roll 13 are operated by driving the related drive motors 52R, 52F, 52K and 52C under control of the synchronizing control circuit. Through this operation, the spreader 4 is retarded or moved backward. At the same time, by the dispensing roller 9, the belt conveyor 11 and the delivery roll 13, the rolled cloth 7 is rolled out and taken out at the retarding speed of the spreader 4 and delivered at the delivering speed, and is spread on the work table 1. When a predetermined amount of the rolled cloth 7 is taken out, the spreader 4, the dispensing roller 9, the belt conveyor 11 and the delivery roll 13 are stopped. Then, the cutter unit 19 is operated to cut the rolled cloth 7 rolled out and spread. In turn, the lifting mechanism is operated and then the lift brackets 17 are lifted a predetermined distance, thereby to lift the cutter unit 19 and the guide roll 18 by a distance corresponding to the thickness of the rolled cloth 7. Subsequently, the spreader 4 is advanced to make it at the forward end in contact with the catcher 3. At this point, one cycle of the spreading operation is completed. This operation is repeated a plurality of cycles to pile up the cut rolled cloth 7 on the work table 1.

As seen from the foregoing, the control voltage for the running motors is modified by a predetermined ratio with little influence from slippage of the running wheels. The modified voltage is straightforwardly applied to the controlled motors. Therefore, those controlled motors are started and stopped simultaneously with the running motor. Errors due to the wheels are corrected by the operational comparing circuits. The results from these features are a very smooth spreading of the cloth, and no trailing and no slackening of the cloth during the spreading operation.

Furthermore, the supporting table for rotatably supporting the cloth roll is mounted to the spreader, while being adjustable in the direction normal to the running direction of the spreader. A belt conveyor for taking out the cloth is further provided to the support table. If so arranged, the width aligning of the cloth, when the cloth is taken out, is smoothly performed.

Additionally, the support table for rotatably supporting the rolled cloth may be horizontally turnable to the spreader, to the running direction of the spreader, and to the opposite direction thereto. This additional structural arrangement allows the employment of an electrical or electronical synchronizing control unit for the structure which is conventionally very complicated or almost rejects the exact sychronization with the controlled motors. This results in a remarkable simplification of such a structure and easy maintenance with the rare occurence of faults.

In the above-mentioned embodiment, preferably provided between the belt conveyor 11 and the delivery roll 13 is the auxiliary belt conveyor 12 which may selectively be interlocked with the delivery roll 13 operable in synchronism with the same or may be disconneted therefrom to operate independently of the delivery roll 13. This mechanism enables the rolled cloth 7 to always be delivered without giving rise to tension in the rolled cloth 7. In cloth innately tending to curl when it is rolled, such as hard shynthetic leather, it is required that a slight tension be applied to the cloth to eliminate such curls. To this end, it is sufficient to disconnect the delivery roll 13 from the auxiliary belt conveyor 12 and to allow the auxiliary belt conveyor 12 to freely run. If so, the rolled cloth 7 transferring on the belt conveyor is slightly pulled.

In the above embodiment, the upper surfaces of the support table 6, which rotatably supports the rolled cloth 7, are formed tapered down toward the dispensing roller 9, as denoted by *6a*. With this tapered edge surface, the rolled cloth 7 is always in contact with the dispensing roller 9. Therefore, the rolled cloth 7 also rotates in synchronism with the dispensing roller 9, thereby to provide a smooth rolling out of the cloth. Because of this tapered edge surfaces for mounting the rolled cloth 7 on the support table 6, all one has to do is merely place the rolled cloth 7 on the edge surfaces, thereby simplifying the mounting work of the rolled cloth 7. If a proper carrying machine is used, the setting work of the rolled cloth 7 may be automized.

Figure 6:
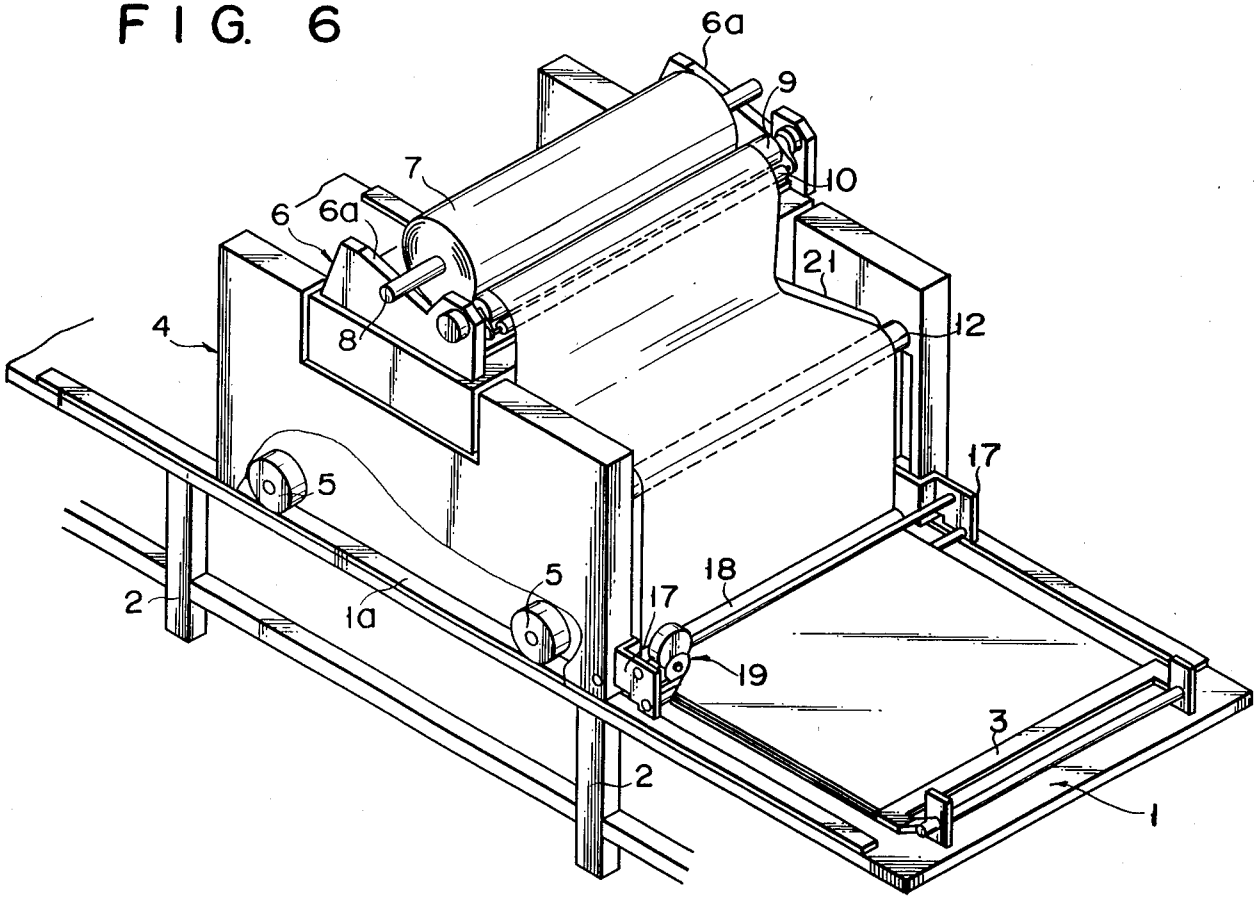
FIG. 6 shows a perspective view of a mechanism for which a second embodiment of the present invention is applied.
Figure 7:
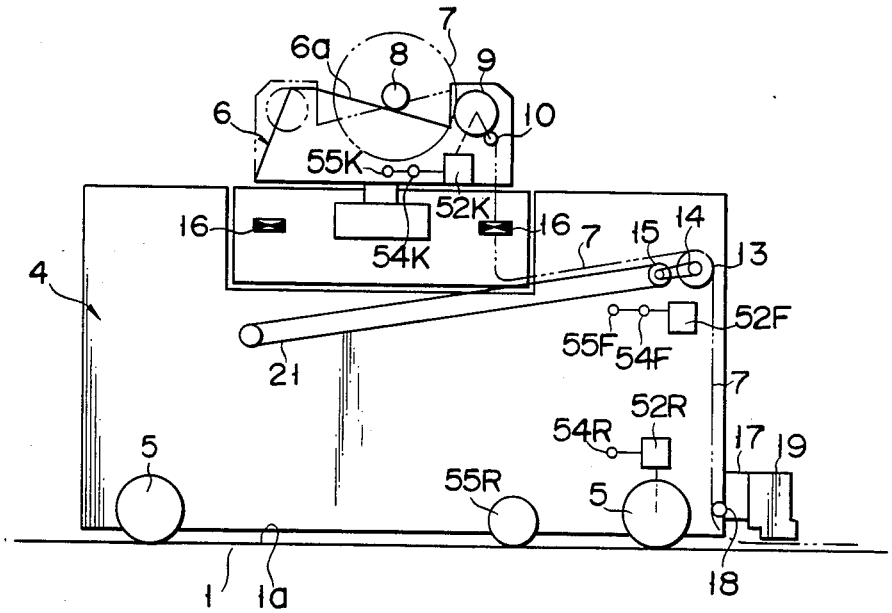
FIG. 7 schematically illustrates a front view of the mechanism of FIG. 6.
Figure 8:
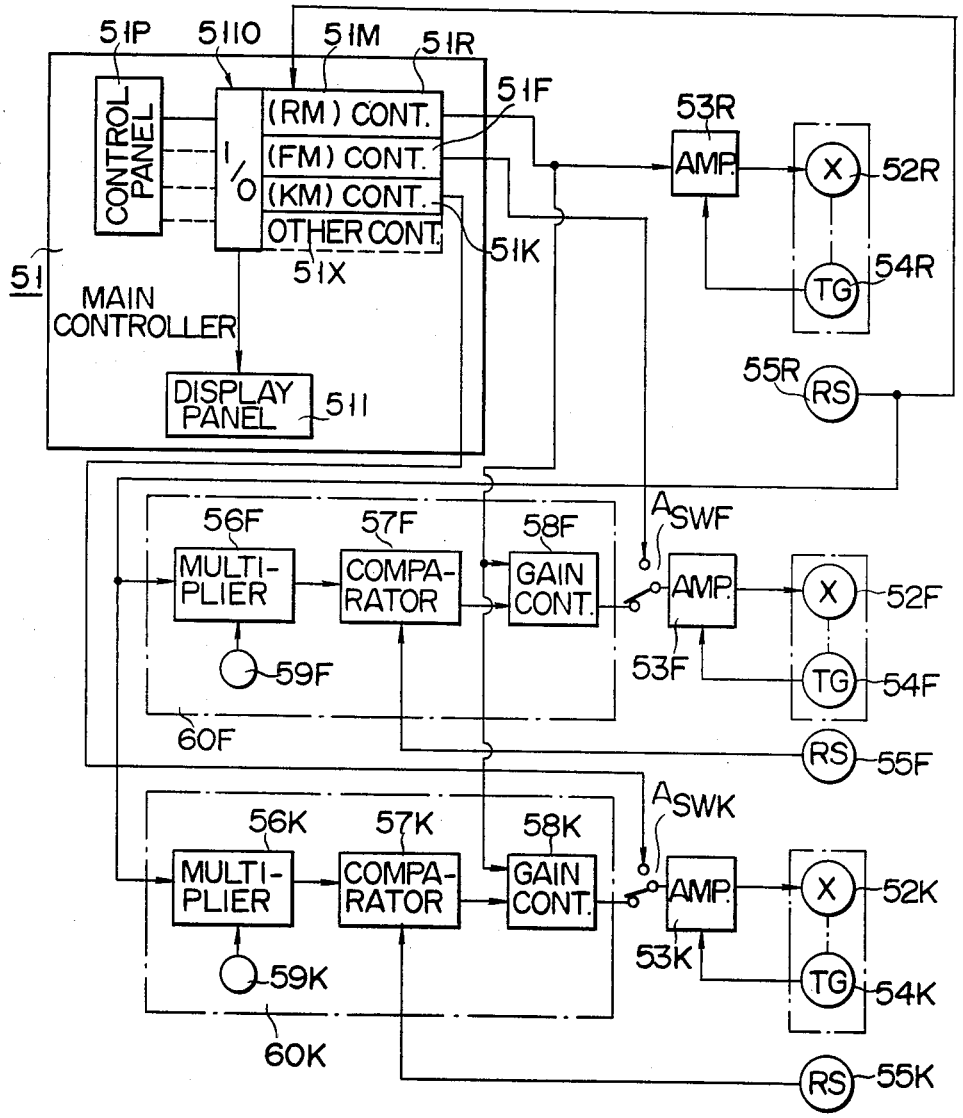
FIG. 8 is a block diagram of a synchronizing control circuit for which the second embodiment of the present invention is applied.

Turning now to FIGS. 6 and 7, there is shown a mechanism to which a second embodiment of the present invention is applied. This embodiment is featured in that a single belt conveyor is used in place of the belt conveyor 11 and the auxiliary belt conveyor 12 in the first embodiment. The remaining structure of this embodiment is substantially the same as that of the first embodiment. FIG. 8 is a synchronizing control circuit to which the second embodiment is applied. This control circuit is also substantially the same as the corresponding one of the first embodiment, except for the conveyor motor 52C, the servo amplifier 53C, the tachogenerator 54C, the control circuit 51C and the operational comparing circuit 60C in the first embodiment.

Also in this embodiment, the mechanism for horizontally turning the support table is available, and this is true for the application of the detailed circuit arrangement of FIG. 5.

The beneficial effects comparable with those in the first embodiment are attainable also in this embodiment, as a matter of course.

I claim:

1. An apparatus for unrolling and spreading a long roll of cloth, said apparatus comprising:

a work table, which is oblong and is positioned horizontally;

a spreader, which has wheels for running on said work table and is positioned such that it runs in the lengthwise direction of said work table;

a support table having surfaces for rotatably supporting the long roll of cloth, said support table being positioned on said spreader and being adjustable in a direction transverse to the running direction of said spreader;

a dispensing roller rotatably supported on said support table for sequentially dispensing the long roll of cloth, which is supported by said support table;

a main belt conveyor, which feeds the long roll of cloth dispensed by said dispensing roller in the running direction of said spreader;

a delivery roller rotatably supported on said spreader for sequentially delivering the long roll of cloth fed by said main belt conveyor onto said work table;

a running servo motor for driving the wheels of said spreader;

a dispensing servo motor for driving said dispensing roller;

a feed servo motor for driving said main belt conveyor;

a delivery servo motor for driving said delivery roller;

first sensing means for sensing the running distance of said spreader;

second and third sensing means for sensing the rotation speeds of said dispensing servo motor and said delivery servo motor, respectively;

a control circuit for generating a first control output signal to drive and control said running servo motor according to a preset input signal and output signal from said first sensing means; and an operation comparing circuit in which a given variable factor of multiplication is coupled with the output signal from said first sensing means, said output signal modified by the multiplication factor is individually compared with the output signals from said second and third sensing means, and said first control output is gain-controlled by each of the results of the comparisons, thereby generating second and third control signals for synchronizing said dispensing and delivery servo motors in rotation with said running servo motor.

2. The apparatus according to claim 1, wherein the surfaces of said support table for rotatably supporting the long roll of cloth are edge surfaces tapered down toward said dispensing roller.

3. The apparatus according to claim 1, wherein said apparatus further comprises an auxiliary belt conveyor provided between said main belt conveyor and said delivery roller, and switchable coupling means for selectively coupling and decoupling said auxiliary belt conveyor and said delivery roller, such that said auxiliary belt conveyor either idles or is driven synchronously with said delivery roller.

4. An apparatus for unrolling and spreading a long roll of cloth, said apparatus comprising:

a work table, which is oblong and is positioned horizontally;

a spreader, which has wheels for running on said work table and is positioned such that it runs in the lengthwise direction of said work table;

a support table having surfaces for rotatably supporting the long roll of cloth, said support table being rotatably supported on said spreader such that it can rotate in the running direction and in a direction opposite to the running direction of said spreader;

a dispensing roller rotatably supported on said support table for sequentially dispensing the long roll of cloth, which is supported by said support table;

a main belt conveyor, which feeds the long roll of cloth dispensed by said dispensing roller in the running direction of said spreader;

a delivery roller rotatably supported on said spreader for sequentially delivering the long roll of cloth fed by said main belt conveyor onto said work table;

a running servo motor for driving the wheels of said spreader;

a dispensing servo motor for driving said dispensing roller;

a feed servo motor for driving said main belt conveyor;

a delivery servo motor for driving said delivery roller;

first sensing means for sensing the running distance of said spreader;

second and third sensing means for sensing the rotation speeds of said dispensing servo motor and said delivery servo motor, respectively;

a control circuit for generating a first control output signal to drive and control said running servo motor according to a preset input signal and output signal from said first sensing means; and an operation comparing circuit in which a given variable factor of multiplication is coupled with the output signal from said first sensing means, said output signal modified by the multiplication factor is individually compared with the output signals from said second and third sensing means, and said first control output is gain-controlled by each of the results of the comparisons, thereby generating second and third control signals for synchronizing said dispensing and delivery servo motors in rotation with said running servo motor.

5. The apparatus according to claim 4, wherein the surfaces of said support table for rotatably supporting the long roll of cloth are edge surfaces tapered down toward said dispensing roller.

6. The apparatus according to claim 4, wherein said apparatus further comprises an auxiliary belt conveyor provided between said main belt conveyor and said delivery roller, and switchable coupling means for selectively coupling and decoupling said auxiliary belt conveyor and said delivery roller, such that said auxiliary belt conveyor either idles or is driven synchronously with said delivery roller.

7. An apparatus for unrolling and spreading a long roll of cloth, said apparatus comprising:

a work table, which is oblong and is positioned horizontally;

a spreader, which has wheels for running on said work table and is positioned such that it runs in the lengthwise direction of said work table;

a support table having surfaces for rotatably supporting the long roll of cloth and being positioned on said spreader;

a dispensing roller rotatably supported on said support table for sequentially dispensing the long roll of cloth, which is supported by said support table;

a belt conveyor, which feeds the long roll of cloth dispensed by said dispensing roller in the running direction of said spreader;

coupling means for coupling said delivery roller and said belt conveyor;

a delivery roller rotatably supported on said spreader for sequentially delivering the long roll of cloth fed by said belt conveyor onto said work table;

a running servo motor for driving the wheels of said spreader;

a dispensing servo motor for driving said dispensing roller;

a delivery servo motor for driving said delivery roller;

first sensing means for sensing the running distance of said spreader;

second and third sensing means for sensing the rotation speeds of said dispensing servo motor and said delivery servo motor, respectively;

a control circuit for generating a first control output signal to drive and control said running servo motor according to a preset input signal and output signal from said first sensing means; and an operation comparing circuit in which a given variable factor of multiplication is coupled with the output signal from said first sensing means, said output signal modified by the multiplication factor is individually compared with the output signals from said second and third sensing means, and said first control output is gain-controlled by each of the results of the comparisons, thereby generating second and third control signals for synchronizing said dispensing and delivery servo motors in rotation with said running servo motor.

8. The apparatus according to claim 7, wherein the surfaces of said support table for rotatably supporting the long roll of cloth are edge surfaces tapered down toward said dispensing roller.

* * * * *